US005209486A

United States Patent [19]

Brotz

[11] Patent Number: 5,209,486

[45] Date of Patent: May 11, 1993

[54] MAGNETIC GAME

[76] Inventor: Gregory R. Brotz, P.O. Box 1322, Sheboygan, Wis. 53081

[21] Appl. No.: 765,542

[22] Filed: Sep. 25, 1991

[51] Int. Cl.[5] ..... A63F 3/00

[52] U.S. Cl. ..... 273/239; 273/450; 273/456; 273/129 R; 273/290

[58] Field of Search ..... 273/336, 337, 118 A, 273/119 R, 119 A, 239, 85 E, 85 F, 85 R, 86 B, 126 R, 126 A, 456, 443, 450, 459, 129 R, 290

[56] References Cited

U.S. PATENT DOCUMENTS

| | | | |
|---|---|---|---|
| 464,098 | 12/1891 | Harr | 273/337 |
| 2,474,365 | 6/1949 | Munn | 273/239 |
| 2,819,904 | 1/1958 | Nelson et al. | 273/239 |
| 3,090,622 | 5/1963 | Sire | 273/126 A |
| 3,214,171 | 10/1965 | Luchsinger | 273/456 X |
| 3,228,555 | 1/1966 | Pinto | 273/239 X |
| 3,235,259 | 2/1966 | Glass et al. | 273/85 F |
| 3,409,295 | 11/1968 | Bernstein | 273/85 F |
| 3,425,694 | 2/1969 | Norris | 273/126 A |
| 3,556,526 | 1/1971 | Currie | 273/239 |
| 3,684,288 | 8/1972 | Grace | 273/239 |
| 3,799,548 | 3/1974 | Lemkin | 273/239 |
| 4,013,293 | 3/1977 | Hess et al. | 273/239 |
| 4,049,275 | 9/1977 | Skelton | 273/239 |
| 4,274,635 | 6/1981 | Pakogian | 273/85 R |
| 4,382,600 | 5/1983 | Vieira | 273/118 R |

*Primary Examiner*—V. Millin
*Assistant Examiner*—Sebastiano Passaniti
*Attorney, Agent, or Firm*—William Nitkin

[57] ABSTRACT

A game having a magnetically permeable game board areas, each of the areas having a magnet positioned thereunder below the game board and a plurality of magnetic game pieces to be propelled by a player by a repeller toward the game board in an effort to position the magnetic game piece on an area having the highest scoring value associated therewith.

2 Claims, 5 Drawing Sheets

MAGNETIC GAME

BACKGROUND OF THE INVENTION

1. Field of the Invention

This invention is a game and more particularly relates to a game having magnetic game pieces which are flipped by a player onto a playing surface of a game board having a grid thereon with a particular scoring value associated with each grid area with the player whose magnetic game pieces fall on the higher value grid areas being the winner of the game.

2. Description of the Prior Art

Tossing games are well known in the art. Many tossing games provide a plurality of holes or spaces into which playing pieces such as bags or balls are thrown. The tossing skill of a player is tested as hard to reach spaces have higher scoring values associated therewith than easy-to-reach spaces.

SUMMARY OF THE INVENTION

It is an object of this invention to provide a game wherein magnetic force is used to attract and retain game pieces on portions of a playing surface divided into a plurality of grid areas. The players can propel magnetic playing pieces from a repeller as will be described below, and the magnetic playing pieces can land on one of the grid areas delineated on the game board. Under each grid area is a magnet to attract one or more magnetic game pieces. The magnetic game pieces will stack on the grid areas to which they are attracted with different colored magnetic game pieces being used by each player for scoring purposes.

DESCRIPTION OF THE PREFERRED EMBODIMENT(S)

Figure 1:
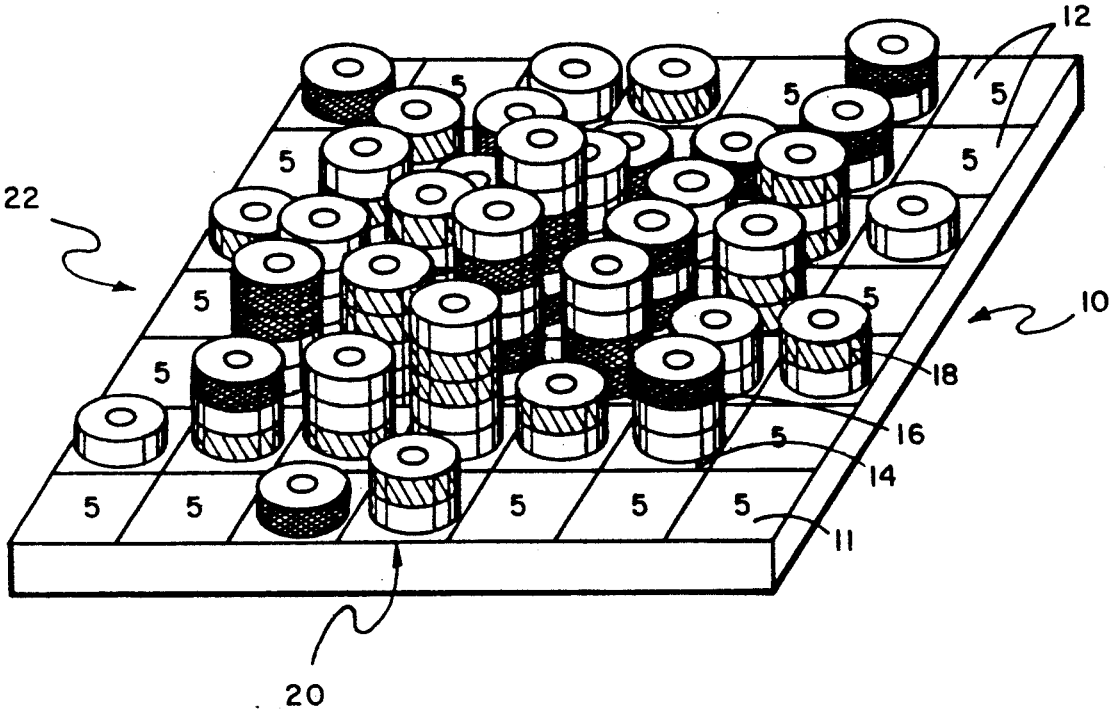
FIG. 1 illustrates the game board of this invention with a plurality of magnetic game pieces stacked thereon.

FIG. 1 illustrates game board 10 of this invention which has a gridwork thereon which includes a plurality of rows 22 and columns 20 to form a plurality of grid areas 12. On each grid area is imprinted a score, the centermost grid area 30 seen on FIG. 2 having a higher scoring value than the peripheral grid areas. For example, the perimeter grid area 11 can have a scoring value of 5 points while the next inward grid area 26 can have a scoring value of 10 points, and the next inward grid area 28 can have a scoring value of 25 points while the centermost grid area 30 has a scoring value of 50 points.

Other scoring arrangements can be used and the scoring system described herein is for illustrative purposes only.

Figure 2:
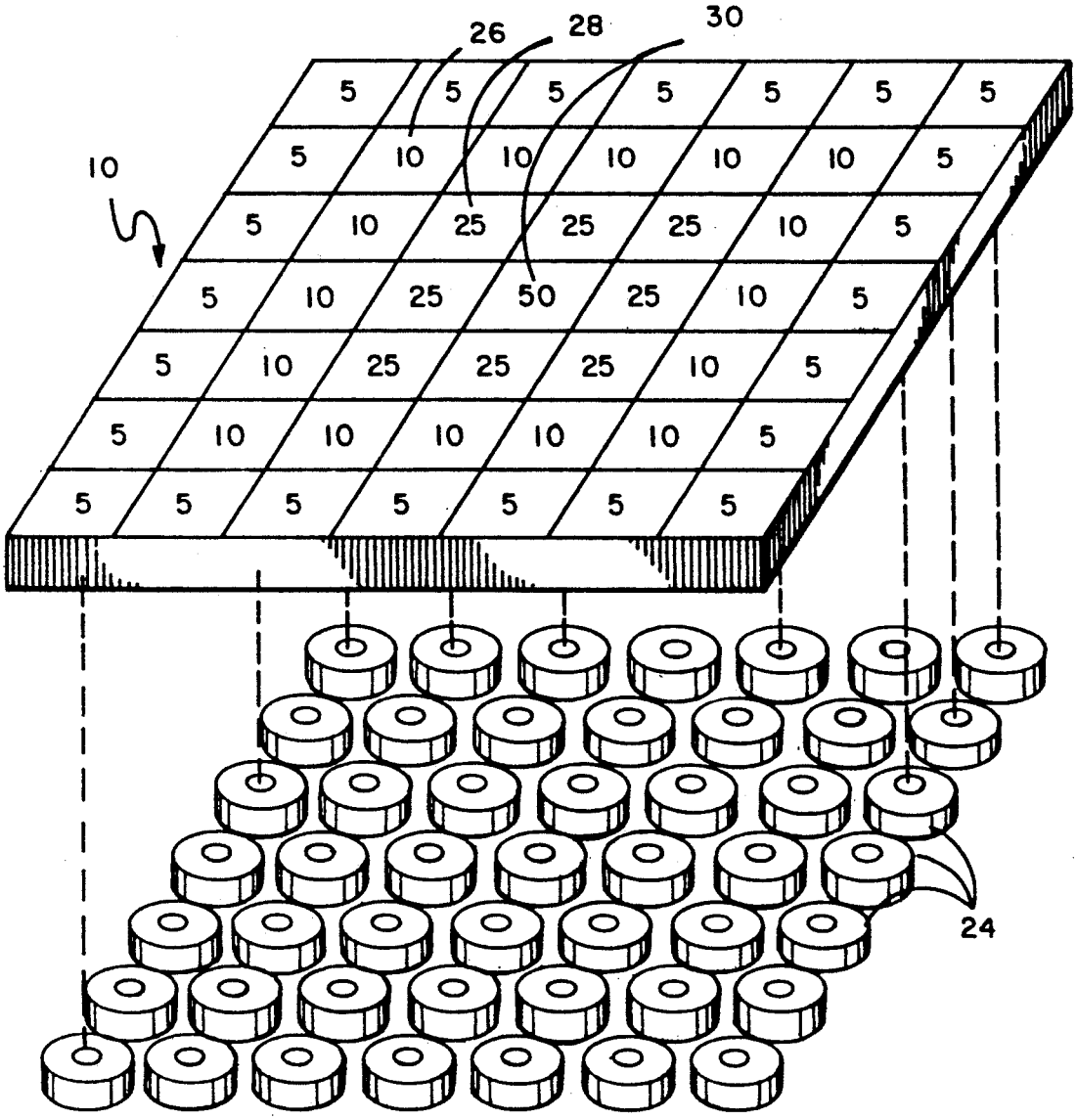
FIG. 2 illustrates the game board of this invention with no game pieces thereon showing the magnets that are disposed under each grid area with each magnet being shown separated downward therefrom as an illustration of their positioning under their respective grid areas.

The game board can be made of a magnetic field permeable material such as cardboard, thin plastic or the like. Disposed beneath each of the grid areas is a separate magnet 24 as seen in FIG. 2. Magnets 24 are shown moved downward away from game board 10 in this Figure, but in use each of these magnets is permanently positioned under a separate grid area 12. During play, each player propels his magnetic game pieces, and when they land on the game board, such game pieces will automatically be attracted to and align with the closest magnet 24 under the game board. Each player will continue to shoot his magnetic game pieces, and the magnetic game pieces will stack upon one another as seen in FIG. 1 due to their magnetic attraction to on another and the magnetic attraction of the magnets under the game board. Each player's magnetic game pieces are designated by a different color for each player. A plurality of magnetic game pieces 16 may stack over one grid area 14 and the winner would be the player having the highest score. Other scoring systems could also be utilized in the game of this invention.

Figure 3:
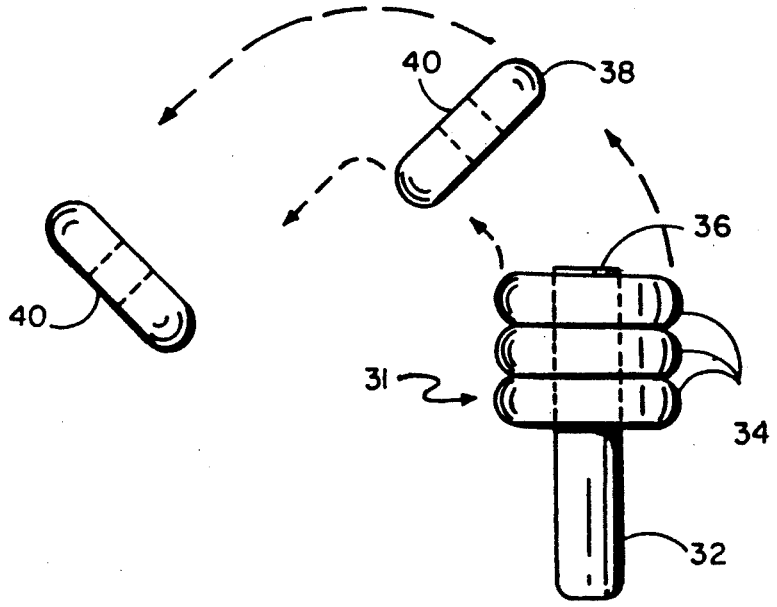
FIG. 3 illustrates a side view of the repeller which can be used to propel the magnetic game pieces toward the game board of this invention.
Figure 4:
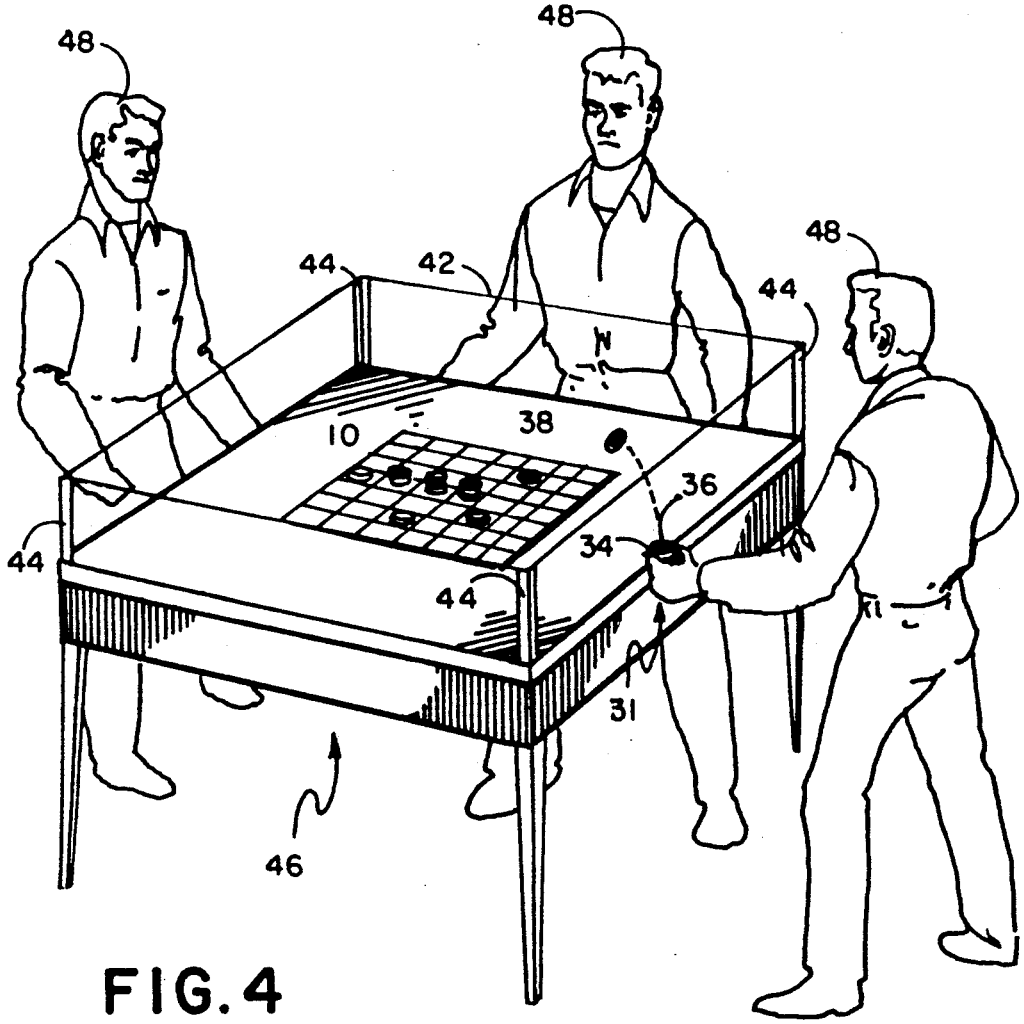
FIG. 4 illustrates three players playing a version of the game of this invention with a distance restricting member positioned around the game board.
Figure 5:
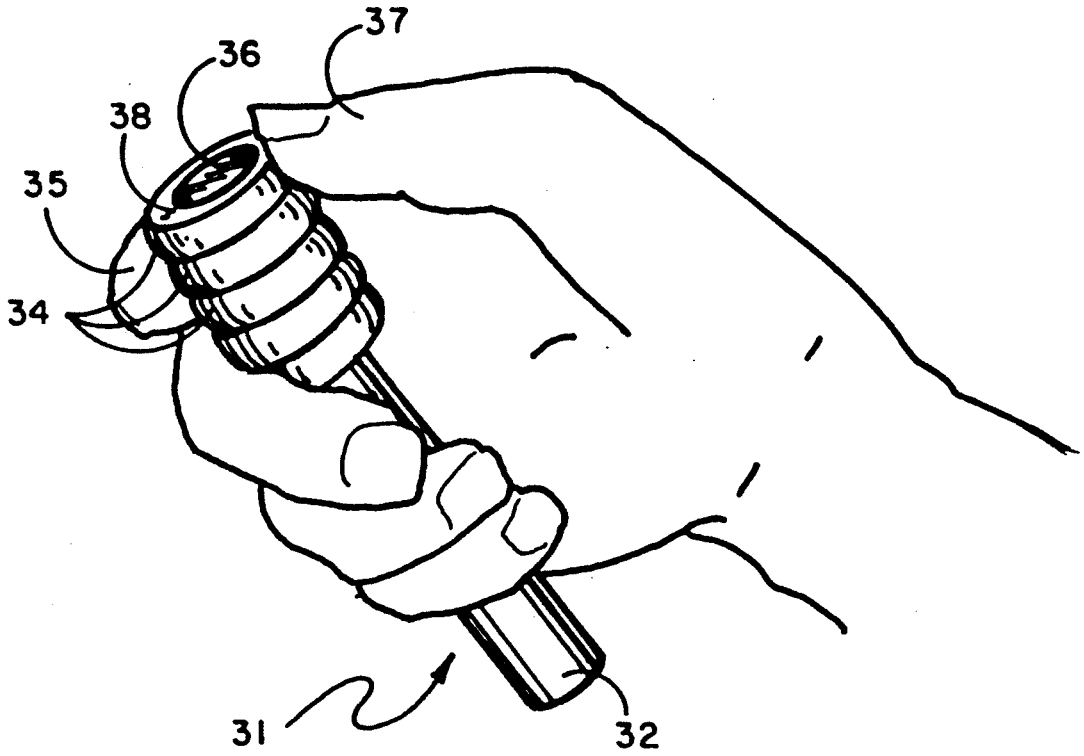
FIG. 5 illustrates a close-up view of the hand of a player operating a repeller.

In a preferred embodiment a player propels a magnetic game piece 38 toward the board by using a magnetic repeller 31 as seen in FIG. 3 which has a handle portion 32. A plurality of magnets 34 are fixed on handle portion 32 which has end portion 36 protruding therefrom. Magnetic game piece 38 has an aperture 40 adapted to fit over end portion 36 extending beyond magnets 34. When a player places magnetic game piece 38 on top of this column of magnets with like magnetic poles facing one another, it is repelled and flies through the air as seen illustrated in FIG. 3. Player 48 with the magnetic game piece 38 thereon aims repeller 31 toward game board 10 and, as seen in FIG. 4, magnetic game piece 38 is propelled toward game board 10 where it will fall and be attracted to the nearest grid area or game piece. Other means to propel the magnetic game pieces can also be utilized in playing the game of this invention. FIG. 5 illustrates a close-up view of repeller 31 held within the player's hand where the magnetic game piece 38 is grasped between the thumb 37 and forefinger 35 and held onto the end portion 36 of handle portion 32. In use one will aim the repeller and slide one's thumb and forefinger downward so that they pass off of magnetic game piece 38 onto the plurality of magnets 34, allowing magnetic game piece 38 to be propelled off end portion 36 onto the game board.

Figure 6:
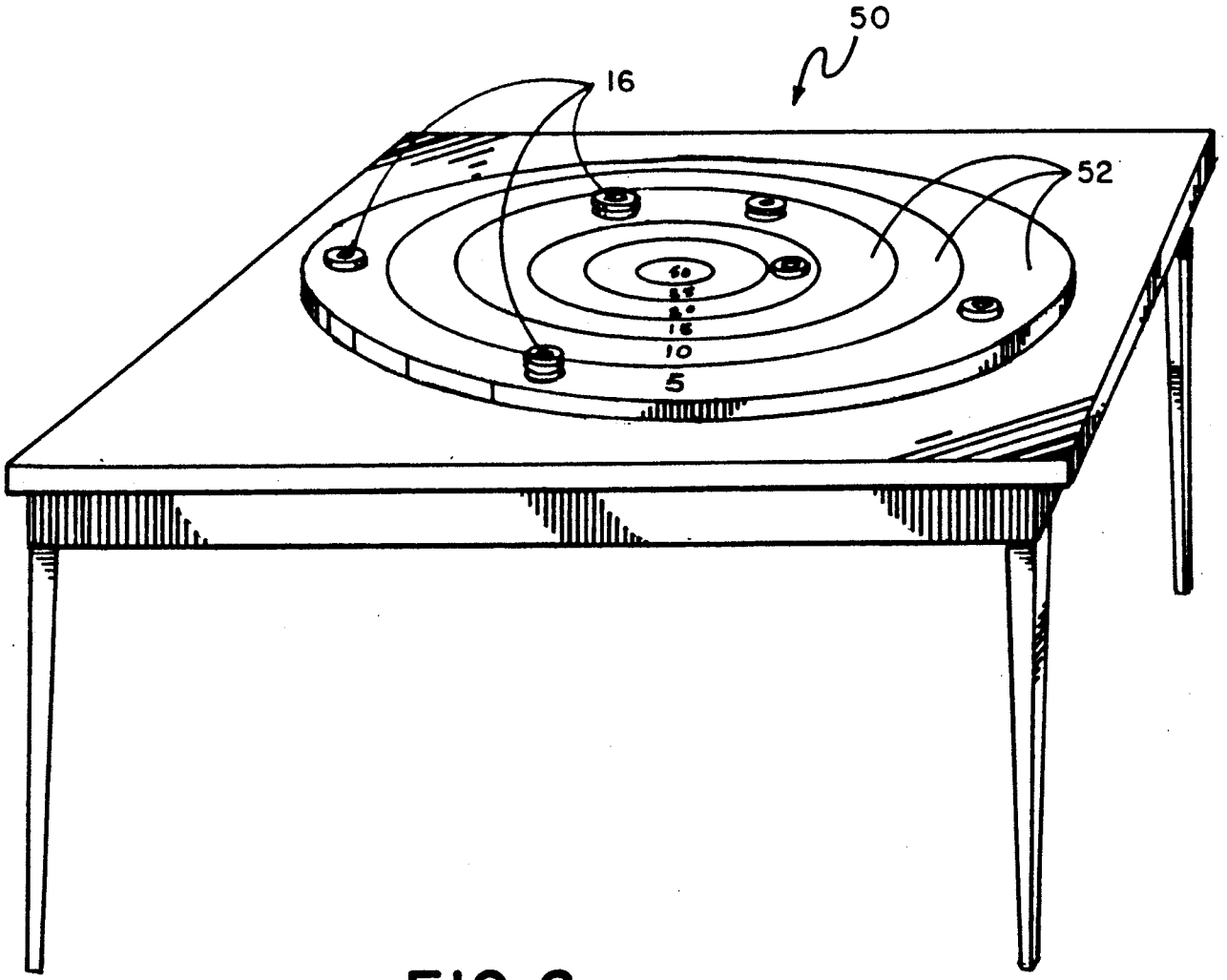
FIG. 6 illustrates an alternate game board having concentric ring scoring areas.

The game board can have a variety of shapes and one alternate embodiment of the game board is seen in FIG. 6 wherein a circular game board 50 is illustrated having concentric rings 52, each with a different scoring value with the higher scoring values being the smaller rings. Each ring will have a plurality of magnets thereunder. The game is played in the same manner as discussed above with the magnetic game pieces 16 propelled onto the game board.

The game of this invention can be played on a table or equivalent playing area. Means can be provided to keep the players from approaching too close to the game board such as a plurality of upright posts 44 interconnected by a string member 42 or equivalent barrier means to create a restricted area from outside of which the players must shoot their game pieces. The restrictive area can also be formed by photoelectric eyes or equivalent sensing means.

Two or more players can play the game of this invention who must exercise skill in aiming their magnetic playing pieces toward those grid areas having the highest scoring values. However, an element of chance also enters into the playing of this game due to the tumbling action of the game pieces as they are propelled toward the game board and the rotation of the pole of the magnetic game pieces which can be attracted or repelled by the grid areas or game pieces already on the game board.

Although the present invention has been described with reference to particular embodiments, it will be apparent to those skilled in the art that variations and modifications can be substituted therefor without departing from the principles and spirit of the invention.

I claim:

1. A game for two or more players comprising:

a game board of magnetic field permeable material having a surface area and a plurality of adjacent areas defined on said surface, each of said areas having a scoring value associated therewith;

a plurality of magnets each disposed under one of said areas;

a plurality of magnetic game pieces each having different indicea for each player;

means to propel one of said plurality of said magnetic game pieces by a player toward said game board such that in a first mode said magnetic game piece is attracted by magnetic attraction to one of said areas and positions itself over the magnet beneath said area and in a second mode said magnetic game piece is attracted by magnetic attraction to a magnetic game piece previously positioned over one of said areas with said magnetic game pieces stackable on one another by magnetic attraction wherein the player having the most magnetic game pieces stacked over the areas with the highest scoring values being the winner of the game: and wherein said means to propel said magnetic game pieces is a repeller having a handle and a top end with magnetic means affixed thereto adapted to repel a magnetic game piece placed at said top end by having the downward-facing side of said magnetic game piece be of the opposite magnetic pole to the magnetic pole of said magnetic means of the repeller to propel said magnetic game piece toward the game board by the player aiming the repeller toward a desired one of said areas having a high scoring value.

2. The game of claim 1 wherein said repeller includes a post member extending above said magnetic means with each of said magnetic game pieces having an aperture defined therein, said post member adapted to receive at least one of said magnetic game pieces and align said game piece with said magnetic means before said repeller is aimed toward a desired area on said game board and said magnetic game piece is manually released by said player, causing said magnetic game piece to be propelled toward said desired area on said game board.

* * * * *